United States Patent [19]

Ang et al.

[11] 4,240,882

[45] Dec. 23, 1980

[54] GAS FIXATION SOLAR CELL USING GAS DIFFUSION SEMICONDUCTOR ELECTRODE

[75] Inventors: Peter G. P. Ang; Anthony F. Sammells, both of Naperville, Ill.

[73] Assignee: Institute of Gas Technology, Chicago, Ill.

[21] Appl. No.: 92,484

[22] Filed: Nov. 8, 1979

[51] Int. Cl.[3] ..... C25B 3/00; H01M 6/30; C25B 1/00

[52] U.S. Cl. ..... 204/75; 204/59 R; 204/72; 204/77; 204/102; 204/252; 204/265; 204/266; 204/280; 204/DIG. 3; 429/13; 429/41; 429/44; 429/45; 429/111

[58] Field of Search ..... 429/111, 41, 44, 45, 429/13; 204/59 R, 72–75, 77, 102, DIG. 3, 252, 265, 266, 280

[56] References Cited

U.S. PATENT DOCUMENTS

| | | | |
|---|---|---|---|
| 3,401,062 | 9/1968 | Lyons, Jr. | 429/111 X |
| 3,834,943 | 9/1974 | Van Den Berghe | 429/41 X |
| 4,167,461 | 9/1979 | Dickson et al. | 204/102 |

OTHER PUBLICATIONS

M. Halmann, "Photoelectrochemical Reduction of Aqueous $CO_2$ on p-type GaP in Liquid Junction Solar Cells," *Nature,* vol. 275, pp. 115–116.

B. Kraevtler et al., "Heterogeneous Photocatalytic Synthesis of Methane from Acetic Acid," *J. Am. Chem. Soc.,* vol. 100, pp. 2239–2240 (1978).

*Primary Examiner*—Aaron Weisstuch

*Attorney, Agent, or Firm*—Thomas W. Speckman

[57] ABSTRACT

A gas diffusion semiconductor electrode and solar cell and a process for gaseous fixation, such as nitrogen photoreduction, $CO_2$ photoreduction and fuel gas photo-oxidation. The gas diffusion photosensitive electrode has a central electrolyte-porous matrix with an activated semiconductor material on one side adapted to be in contact with an electrolyte and a hydrophobic gas diffusion region on the opposite side adapted to be in contact with a supply of molecular gas.

52 Claims, 4 Drawing Figures

GAS FIXATION SOLAR CELL USING GAS DIFFUSION SEMICONDUCTOR ELECTRODE

BACKGROUND OF THE INVENTION

1. Field of the Invention

This invention relates to a gas diffusion semiconductor electrode and solar cell and a process for gaseous fixation, such as nitrogen photoreduction. In one embodiment, the solar cell has a gas diffusion photosensitive cathode with p-type semiconductor material on the surface of a porous matrix diffusion layer in contact with an electrolyte and forming one side of a flowing liquid electrolyte chamber, the opposing side of the electrolyte chamber being formed by an anode through which light may pass for the illumination of the p-type semiconductor photocathode. The electrolyte is capable of providing ionic conductance between the cathode and anode and an external electrical circuit between the cathode and anode completes the circuit and has a power source capable of providing a bias voltage to the p-type semiconductor material. Nitrogen may be reduced to ammonia or hydrazine by passing a nitrogen containing gas through a porous matrix diffusion layer of the gas diffusion photosensitive cathode while the p-type semiconductor is illuminated.

2. Description of the Prior Art

Fixation of nitrogen by combination with oxygen has been effected by use of the electric arc as a source of energy as taught by U.S. Pat. No. 2,134,206 and by means of high energy ionizing radiation to irradiate a catalytic bed as taught by U.S. Pat. No. 3,378,475.

Photoreduction of nitrogen to produce ammonia and hydrazine has received considerable recent attention. The fixation-reduction of molecular nitrogen promoted under mild conditions in solution by lower valent titanium using alkali metal or naphthalene radical anion as a reducing agent has been described in the references E. E. van Tamelen, G. Boche, S. W. Ela, and R. B. Feehter, J. Am. Chem. Soc., 89, 5707 (1967); E. E. van Tamelen, and M. A. Schwartz, ibid., 87, 3277 (1975); and E. E. van Tamelen, G. Boche and R. Greeley, ibid., 90, 1677 (1968). Electrolytic reduction of molecular nitrogen to the ammonia level utilizing a titanium coordinating species in an aluminum chloride electrolyte is taught by E. E. van Tamelen, Bjorn Akermark, ibid., "Electrolytic Reduction of Molecular Nitrogen" pps. 4492–4493 (1968). The catalytic effect of titanium in the electrolytic reduction of nitrogen in a titanium-aluminum system is described in E. E. van Tamelen, Douglas A. Seeley, "The Catalytic Fixation of Molecular Nitrogen by Electrolytic and Chemical Reduction", ibid., 91, 5194 (1969). Reduction of molecular nitrogen to ammonia and hydrazine by reaction of sulfuric acid with tungsten and molybdenum complexes is taught by J. Chatt, A. J. Pearman, R. L. Richards, "The Reduction of Mono-Coordinated Molecular Nitrogen to Ammonia in a Protic Environment", Nature, 253, 39–40 (1975).

Photolysis of water and photoreduction of nitrogen on titanium dioxide doped with iron in a catalyst bed is described in G. N. Schrauzer, T. D. Guth, "Photolysis of Water and Photoreduction of Nitrogen on Titanium Dioxide", J. Am. Chem. Soc., 99, 7189–7193 (1977); G. N. Schrauzer, "Prototype Solar Cell Used in Ammonia Process", C & E N, 19–20, (Oct. 3, 1977). Photo enhanced reduction of nitrogen on p-GaP electrodes using an aluminum anode and a non-aqueous electrolyte in a galvanic cell is taught by C. R. Dickson, A. J. Nozik, "Nitrogen Fixation via Photoenhanced Reduction on p-GaP Electrodes", J. Am. Chem. Soc., 100, 8007–8009 (1978). One disadvantage of the described system is that aluminum is consumed in its function as a reducing agent.

SUMMARY OF THE INVENTION

This invention provides a gas diffusion photosensitive electrode having an activated semiconductor material on the surface of a porous matrix diffusion layer which is in contact with an electrolyte on one side and in contact with hydrophobic gas diffusion region on the opposite side of the porous matrix. The semiconductor material may be a p-type semiconductor to obtain photoreduction of a molecular gaseous material or an n-type semiconductor to obtain photo oxidation of a gaseous material. The semiconductor is illuminated by light passing through an opposing counterelectrode. The gaseous chemical for fixation is passed through a hydrophobic diffusion region on the outside of the electrode, as is presently known to the art for use in gas diffusion electrodes, such as polytetrafluoroethylene. The electrolyte may be an aqueous or non-aqueous electrolyte capable of providing ionic conductance between the electrodes, the electrical circuit being completed by an external electrical circuit which is capable of providing a bias voltage to the semiconductor electrode. The semiconductor on the surface of a porous matrix diffusion layer provides an interface between the semiconductor electrode, the incoming light energy, the electrolyte and the gas to be fixed. Photoreduction of the gas may be obtained by using a p-type semiconductor on the diffusion layer of a gas diffusion photosensitive cathode while a photo-oxidation fixation may be obtained by having an n-type semiconductor material on the surface of a porous matrix diffusion layer of a gas diffusion photosensitive anode.

In one embodiment, this invention relates to a process for production of ammonia or hydrazine by photoreduction of nitrogen. A nitrogen containing gas, such as pure nitrogen or a nitrogen-hydrogen mixture, is passed through a porous matrix diffusion layer of a gas diffusion photosensitive cathode and the gas is brought into contact with a p-type semiconductor supported by the porous matrix diffusion layer and in contact with a liquid electrolyte. The gas may also provide the supply of hydrogen necessary to the photoreduction. The p-type semiconductor is illuminated by passing light through an opposing light passing anode and the liquid electrolyte to produce a positive shift in the potential of the semiconductor. Cathodic photocurrent results in reduction of the nitrogen at the semiconductor-electrolyte interface with concomitant oxidation of the electrolyte at the counterelectrode. Ionic conductance is provided between the cathode and anode by the liquid electrolyte in contact with the cathode and anode. Removal of the formed ammonia or hydrazine from and supply of electroactive electrolyte to the cathode is also provided by the flowing electrolyte. Electrons produced by oxidation of the electrolyte at the anode are passed through an external electronic circuit to the cathode for completion of the electronic circuit. The external electronic circuit may or may not, as required by the reaction, provide a bias voltage to the cathode from an external power source. Presently used commercial methods for producing ammonia, which is used primarily for fertilizer, involve the Haber-Bosch process which reduces nitrogen under temperatures of about 500° C. and pressures of about 350 atmospheres, much more energy consuming than processes of the present invention.

It is an object of this invention to provide gas diffusion semiconductor electrodes for solar assisted gaseous fixation by photoelectrochemical reduction or oxidation.

It is yet another object of this invention to provide a gas diffusion semiconductor solar cell for providing energy for reduction of molecular gaseous species.

It is still another object of this invention to provide a process for the photoreduction or photo oxidation of gaseous species utilizing less energy than previous methods.

Yet another object of this invention is to provide a process for the photoreduction of nitrogen to provide ammonia and hydrazine utilizing less energy than previous processes.

Still another object of this invention is to provide a process for the photoreduction of $CO_2$ to produce methanol and methane.

It is another object of this invention to provide a gas diffusion photosensitive cathode having p-type semiconductor material on the surface of a porous matrix diffusion layer providing four phase interface between the activated semiconductor, light, electrolyte and gas.

BRIEF DESCRIPTION OF THE DRAWINGS

Other objects and advantages of the invention will become apparent upon further reading of the description and reference to the drawings showing preferred embodiments wherein.

DESCRIPTION OF THE PREFERRED EMBODIMENTS

Figure 1:
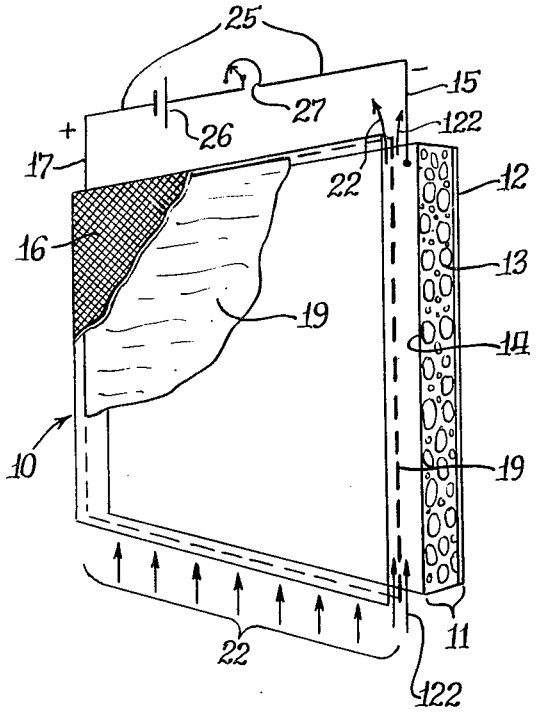
FIG. 1 is a schematic, perspective, partially cutaway view of one embodiment of a gas diffusion semiconductor solar cell according to this invention.
Figure 2:
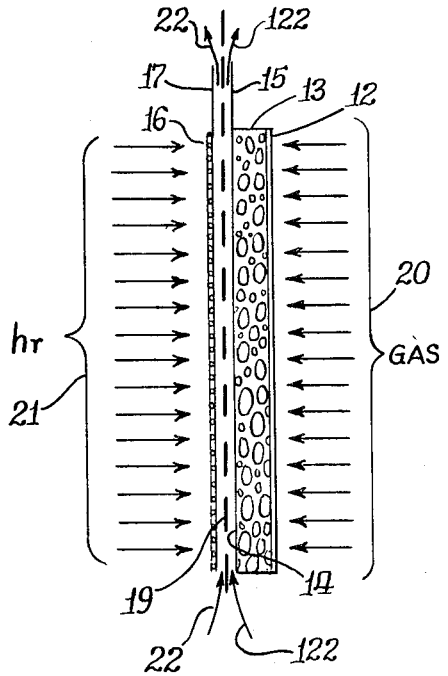
FIG. 2 is an end view of a gas diffusion semiconductor solar cell according to this invention.

Referring to FIGS. 1 and 2, gas diffusion semiconductor solar cell 10 is shown schematically with gas diffusion semiconductor electrode 11 and opposing light passing counterelectrode 16 with a flowing electrolyte chamber therebetween. As shown in FIG. 1, gas diffusion semiconductor electrode 11 is the cathode and light passing counterelectrode 16 is the anode, while in FIG. 2, the electrodes may be of either polarity. As shown in FIG. 1, gas diffusion semiconductor cathode 11 has hydrophobic diffusion region 12 which may be any material permitting gas passage from the exterior to the interior while preventing electrolyte liquid passage from the cell. Organic polymer gas diffusion coatings and sheets are known to the art for gas diffusion cells and such materials are suitable for the diffusion electrode of this invention, such as polytetrafluoroethylene. Teflon hydrophobic gas diffusion regions in the form of coatings or sheets of thicknesses of about 1 micron to 0.5 mm are suitable and are presently known to the art for use in gas diffusion electrodes. However, any material having the required properties of gas passage while retaining the liquid electrolyte would be suitable.

Figure 3:
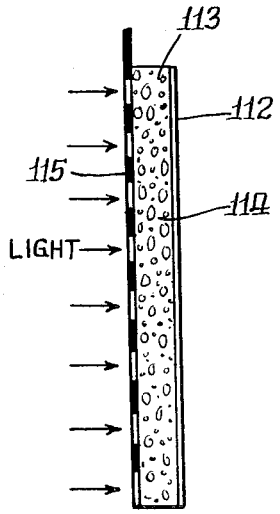
FIG. 3 is an end view of another embodiment of a gas diffusion photosensitive electrode according to another embodiment of this invention.

Porous matrix 13 contacts hydrophobic diffusion region 12 on its outer side and the electrolyte on its inner side. The porous matrix may be any suitable material providing desired porosity and stability in the electrolyte and gaseous environment by being relatively non-reactive with the electrolyte and gaseous components. Such materials are known to the art such as porous matrices of polytetrafluoroethylene (Teflon), fritted glass, nickel, titanium, carbon, graphite and mixtures thereof. The porous matrix may be about 0.1 mm to 3 mm thick. When the porous matrix provides high electrical conductivity, such as nickel, it may serve as the current collector providing transport of electrons between the external electronic circuit and the chemical reaction sites. When the porous matrix is a nonelectrical conductor, such as Teflon, an electron conducting current collector must be used to provide transport of electrons between the external electronic circuit and the chemical reaction sites. Suitable current collectors are known to the art and may be mounted on the electrolyte side of the porous matrix adjacent the semiconductor material and electrically insulated from the electrolyte. FIG. 3 shows a schematic sectional view through a photoelectrode having a Teflon sheet hydrophobic layer 112, sprayed Teflon porous matrix 113 with semiconductor coating 114 and light passing current collector 115 in electrical communication with semiconductor 114 and insulated from the electrolyte. The porosity of the matrix should be sufficient to promote the four component interface of the gas, semiconductor, light (photons) and electrolyte. Presently available porous materials, such as nickel, provide about 50 to 75 percent porosity.

Semiconductors are applied to the electrolyte side of the porous matrix by thermal vacuum evaporation, sputtering, electrodeposition, chemical vapor deposition, or spraying thereby providing semiconductor layers about 1 $\mu$m to 1 mm thick.

FIG. 1 shows gas diffusion semiconductor photocathode 11 which has a p-type semiconductor supported by the porous matrix of diffusion layer 13. Suitable materials for use as the p-type semiconductor of the photocathode of this invention include $Cu_2O$, $Cu_2S$, Si, Ge, SiC, CdTe, $TiO_2$, CdSe, ZnTe, GaP, GaAs, InAs, AlAs, AlSb, GaSb, InP, Chalcopyrites, $CuInS_2$, $CuGaS_2$, $CuAlS_2$, $CuAlSe_2$, $CuInSe_2$, $ZnSiAs_2$, $ZnGeP_2$, $ZnSnAs_2$, $ZnSnP_2$, $ZnSnSb_2$, $CdSnP_2$ and $CdSnAs_2$. The above chemicals must be appropriately doped with at least one p-type material, as is known to the art, for production of the p-type semiconductor. GaP, ZnTe, InP, SiC and Si appropriately doped to make them p-type semiconducting materials are preferred. Particularly suitable are the following doped p-type semiconductors: Zn-doped GaP, Ag-doped ZnTe, Zn-doped InP, Al-doped SiC and B-doped Si.

Likewise, a gas diffusion photosensitive anode according to this invention may be provided by using an n-type semiconductor on the surface of a porous matrix diffusion layer instead of the p-type semiconductor as described above. Suitable materials for use in the n-type semiconductor of the photoanode assembly of this invention include: $Fe_2O_3$, ZnTe, $WO_3$, $MoS_2$, $MoSe_2$, $TiO_2$, $MTiO_3$, where M is a transition metal element or rare-earth metal element, $TiO_2$ heavily doped with compensated donor-acceptor pairs such as $Ni^{2+}$—$Sb^{5+}$, $Co^{2+}$—$Sb^{5+}$, etc., Si, Te, SiC, CdS, CdSe, CdTe, ZnSe, GaP, GaAs, InP, AlAs, AlSb, GaSb, $Cd_{1-x}Zn_xS$, $GaAs_xP_{1-x}$, $GaIn_{1-x}As$, $Al_xGa_{1-x}As$, Chalcopyrites, $CuInS_2$, $AgInSe_2$, $AgInS_2$, $CuInSe_2$, $ZnSiP_2$, $CdSiP_2$, $CdSnP_2$, $CdSnAs_2$ and polyacetylene. The above chemicals must be appropriately doped with at least one n-type material, as is known to the art, for production of the n-type semiconductor. GaAs, CdSe, $MoS_2$, Si, $TiO_2$, $MoSe_2$ and $Fe_2O_3$ appropriately doped to make them n-type semiconducting materials are preferred and GaAs, $Fe_2O_3$ and Si are especially preferred as the n-type semiconductor electrode for use in this invention.

The semiconductor provides low resistivity, in the order of 0.001 to 10 ohm-cm. As shown in FIG. 1, external electronic circuit 25 provides electronic communication from anode 16 to cathode 11. Anode 16 has anode external lead 17 in electronic contact with the anode and cathode 11 has cathode external lead 15 in electronic contact with the cathode, both external leads being joined by external electronic circuit 25. Power source 26 may be provided to furnish a bias voltage of up to about 3 volts to the semiconductor through adjustable rheostat 27 for reduction. For oxidation a load is provided in the external circuit, which may be for production of electricity.

A light passing counterelectrode is positioned opposing the electrode having the semiconductor providing for passage of light through the counterelectrode to illuminate the semiconductor material on the gas porous diffusion electrode. In FIG. 1, anode 16 is shown as a metallic screen. Any light passing structure, such as woven screening, porous matting, perforated metal sheet, light transparent tin oxide or indium oxide film and the like is suitable as long as it provides electrode functions and permits light passage to illuminate the semiconductor. The counterelectrode may be constructed of any material having suitable electron conductance properties while having long term stability in the electrolyte and cell environment. Any of the noble metals are suitable and preferred are nickel, ruthenium, platinum, titanium and carbon. The thickness of the light passing counterelectrode is that necessary to provide good electronic conductivity and mechanical strength, usually in the order of about 25$\mu$ to 3 mm. As shown in FIG. 1, the light passing counterelectrode functions as an anode in conjunction with p-type semiconductor gas diffusion photosensitive cathode. When an n-type semiconductor is utilized, the gas diffusion photosensitive electrode becomes the anode and the light passing counterelectrode becomes the cathode while the electronic flow in the external circuit is reversed.

The electrolyte chamber provided between the electrodes for flowing electrolyte is capable of providing ionic conductance between the cathode and anode. It is desired to have as thin an electrolyte chamber as practical to provide low resistance and efficient ionic conductance while maintaining sufficient volumetric flow for supply of electroactive electrolyte to the gas diffusion electrode and removal of formed chemical product from the gas diffusion electrode. Light passing and ionic conducting separator 19 is provided for chemical separation of anolyte and catholyte portions of the electrolyte. Separate electrolyte stream flows 22 and 122 are shown in FIGS. 1 and 2 divided by separator 19. Suitable electrolyte separators are known to the art with light passing membranes Nafion (a sulfonated fluoropolyethylene sold by DuPont), Thirsty Glass (96% silica glass sold by Corning Glass Works, Corning, N.Y.), polyethylene and polyvinylchloride being preferred for acid electrolytes and nylon and polymethacrylic acid being preferred for alkaline electrolytes. The liquid electrolyte provides three phase interface between the semiconductor-electrolyte-gas at the site of the semiconductor on the porous matrix diffusion layer. Suitable electrolytes, both aqueous and non-aqueous will be apparent to one skilled in the art in view of this disclosure. Especially preferred aqueous electrolytes include both acidic and basic electrolytes such as $H_2SO_4$, $H_3PO_4$, HCl, KOH and NaOH. Preferred non-aqueous electrolytes include glyme (1,2-dimethoxyethane) with titanium tetraisopropoxide, acetonitrile and propylene carbonate. When non-aqueous electrolytes are used, hydrogen may be supplied with the gas stream through the gas diffusion electrode.

The electrode assembly and electrolyte compartment as described above may be maintained in any suitable container which provides gas passage through the gas diffusion electrode and light passage through the counterelectrode and separator. Multiple gas diffusion semiconductor solar cells according to this invention may be mounted in parallel by manifolding the electrolyte supply and outlet to the individual cells. Means is provided, not shown in the figures, for maintaining proper flow of the electrolyte through the electrolyte chamber by any suitable pump means known to the art. Also, means may be provided exterior to the diffusion semiconductor solar cell for removal of the formed products, such as ammonia and hydrazine. The formed products may be removed by chemical precipitation or any other suitable manner. The electrolyte may then be recirculated back to the cells.

The solar cells of this invention may be operated at pressures of about ambient to 5 atmospheres and temperatures of about ambient to 200° C., with operation at about ambient pressures and temperatures being preferred.

This invention provides a process for gaseous photofixation by passing a molecular gas through a porous matrix diffusion layer of a gas diffusion photosensitive electrode into contact with a semiconductor supported by the porous matrix diffusion layer. Illumination is passed through an opposing light passing counterelectrode and a liquid electrolyte to illuminate the semiconductor. The liquid electrolyte is in contact with both the counterelectrode and the electrode. Illumination of the semiconductor with the photons produces a positive shift in the potential of the semiconductor causing an electrode photocurrent. The electrode photocurrent so produced causes fixation of the gas by reduction of the gas with a p-type semiconductor at the semiconductor-electrolyte interface with concomitant oxidation of the electrolyte at the counterelectrode, or oxidation of the gas with an n-type semiconductor at the semiconductor-electrolyte interface with concomitant reduction of the electrolyte at the counterelectrode. Ionic conductance between the electrode and counterelectrode is provided by a flowing liquid electrolyte in contact with the electrode and counterelectrode. The anolyte and catholyte portions of the electrolyte are chemically separated by a light passing and ionic conducting separator. Removal of the fixed gas from the electrolyte and supply of electroactive electrolyte to the electrode is supplied by means external to the cell. Electrons are passed through an external electronic circuit for completion of the electronic circuit. The external electronic circuit provides a bias voltage to the semiconductor for reduction.

Figure 4:
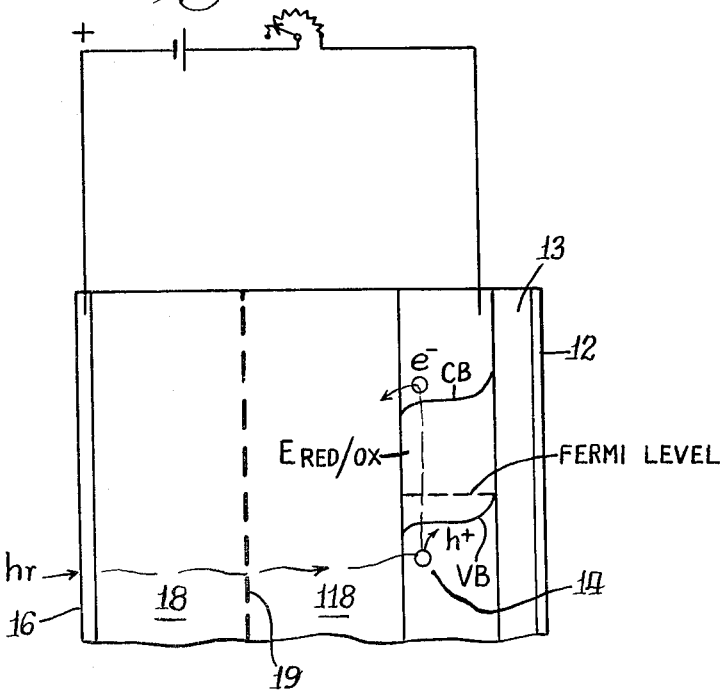
FIG. 4 is an energy diagram showing energy levels in a gas diffusion semiconductor solar cell according to this invention.

One important process which may be conducted according to this invention is the photoreduction of nitrogen to ammonia and hydrazine. A gas containing a substantial proportion of nitrogen, pure nitrogen or a nitrogen-hydrogen mixture, is passed through the porous matrix diffusion layer of the gas diffusion photosensitive cathode of the cell described above and contacts a p-type semiconductor supported by the porous matrix diffusion layer. The p-type semiconductor is illuminated by light passing through an opposing light passing anode and the intervening liquid electrolyte and separator. The photons produce a positive shift in the potential of the semiconductor. Cathodic photocurrent produces reduction of the nitrogen to ammonia or hydrazine at the cathode. ($6HOH+6e^-+N_2 \rightarrow 2NH_3+6OH^-$) These reactions take place at the three phase interface of gas-semiconductor-electrolyte. The concomitant oxidation of the electrolyte takes place at the anode. ($4OH^- \rightarrow O_2+2HOH+4e^-$) FIG. 4 shows energy levels in the gas diffusion semiconductor solar cell used in this fashion. The photons are shown passing through anode 16, anolyte compartment 18, ionic conducting separator 19, catholyte compartment 118 to illuminate p-type semiconductor 14. Ionic conductance is provided by the flowing liquid electrolyte between the cathode and anode, the electrolyte also providing removal of the formed ammonia or hydrazine from and supply of the electroactive electrolyte to the cathode. Electrons produced by oxidation of the electrolyte at the anode are passed through an external electronic circuit to the cathode for completion of the electronic circuit, the external electronic circuit further providing a bias voltage to the cathode from an external power source.

Another photoreduction process is the the reaction of $CO_2$ to produce methanol and methane according to the equations $$CO_2+2H_2O+2e^- \rightarrow HCOOH+2OH^-$$

$$HCOOH+H_2O+2e^- \rightarrow HCHO+2OH^-$$

$$HCHO+2H_2O+2e^- \rightarrow CH_3OH+2OH^-$$

$$CH_3OH+H_2O+2e^- \rightarrow CH_4+2OH^-$$

This process can be carried out in the same manner as described above by substitution of carbon dioxide for nitrogen gas. The photochemical reduction of carbon dioxide by prior processes has been taught by T. Inoue, A. Fujishima, S. Konishi and K. Honda, Photoelectrocatalytic Reduction of Carbon Dioxide in Aqueous Suspensions of Semiconductor Powders, Nature 277, 637–638, 1979, M. Halmann, Nature 275, 155 (1978), J. C. Hemminger, R. Carr & G. A. Somorjai, Chem. Phys. Lett. 57, 100 (1978). "The Photoassisted Reaction of Gaseous Water and Carbon Dioxide Adsorbed on the $SrTiO_3$ (111) Crystal Face to Form Methane."

Likewise, photo-oxidation may be achieved by reversal of electrode polarity. In the oxidation mode, the gas diffusion semiconductor electrode may be used for oxidizing fuels that usually are difficult to oxidize electrochemically. These fuels are for example, methane, butane, propane, CO and ammonia. A fuel cell utilizing the gas diffusion semiconductor electrode comprises the gas diffusion semiconductor photoanode where the fuel gas is oxidized photoelectrochemically and a gas diffusion oxygen/air cathode where oxygen is reduced electrochemically or photoelectrochemically. Such a cell converts the chemical energy of the fuel and oxygen gases to electricity.

The following examples are set forth for specific exemplification of preferred embodiments of the invention and are not intended to limit the invention in any fashion.

EXAMPLE I

A gas diffusion semiconductor electrode is fabricated using a porous nickel (65% porosity) matrix. Zn-doped GaP semiconductor is deposited on the surface of one side of the matrix by sputtering technique. The thickness of the semiconductor layer is approximately 50 $\mu$m. The opposite side of the matrix is coated with Teflon by brushing a Teflon solution on the surface. The Teflon layer is cured at about 350° C. for about 30 minutes in air. Electrical contact to the diffusion electrode is made by appropriately attaching a wire as a lead. A cell is made with a Nafion separator between the anolyte and catholyte. The electrolytes are 6M KOH and they are flowing at a rate of about 10 ml/minute. A platinum foil about 50$\mu$ thick is used as a counterelectrode. A mixture of 25% $N_2$ and 75% $H_2$ gas is supplied to the diffusion electrode at a rate of about 20 $cm^3$/minute. A bias voltage from an external battery of about 2 volts is applied between the semiconductor electrode and the counterelectrode, the negative terminal being the semiconductor diffusion electrode. The semiconductor surface is then illuminated with Xenon light with a heat absorbing filter at approximately 100 mW/$cm^2$ light intensity. Approximately $10^{-4}$ mol $NH_3$ is produced per hour per $cm^2$ of electrode surface.

EXAMPLE II

A gas diffusion semiconductor electrode is fabricated using a porous nickel (65% porosity) matrix. Activated n-type CdSe semiconductor is thermal vacuum evaporated on the surface of one side of the matrix to a thickness of approximately 50 $\mu$m. The opposite side of the matrix is coated with Teflon by brushing a Teflon solution on the surface. The semiconductor is annealed and the Teflon layer is cured at about 350° C. for about 30 minutes in air. Electrical contact to the diffusion electrode is made by appropriately attaching a wire as a lead. A conventional Teflon bonded gas diffusion electrode is used as an oxygen cathode and it is placed side by side in parallel with the gas diffusion n-type semiconductor anode so as not to block the beam of light for illumination of the n-type semiconductor. A solution of 6 M KOH serves as the electrolyte in contact with both electrodes. The gas diffusion n-type semiconductor anode is fed with methane and the cathode is fed with oxygen gas. The n-type semiconductor is illuminated with approximately 100 mW/$cm^2$ light from a Xenon light source. The fuel cell develops a voltage of about 1 volt and short circuit current of about 10 mA/$cm^2$ of semiconductor area can be measured.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A gas diffusion semiconductor solar cell comprising in combination:

a gas diffusion photosensitive electrode comprising a central electrolyte-porous matrix layer having an activated semiconductor material on one side in contact with an electrolyte forming one side of a flowing liquid electrolyte chamber and a hydrophobic gas diffusion region on the opposite side of said porous matrix layer;

an opposing light passing counterelectrode forming the opposite side of said electrolyte chamber whereby light may pass through said counterelectrode and said liquid electrolyte to illuminate said semiconductor material;

said electrolyte within said electrolyte chamber capable of providing ionic conductance between said electrode and counterelectrode, said electrolyte chamber having a light passing and ionic conducting separator for chemical separation of anolyte and catholyte portions of the electrolyte; and an external electrical circuit between said electrode and counterelectrode.

2. The gas diffusion semiconductor solar cell of claim 1 wherein said porous matrix diffusion layer has a hydrophobic diffusion region on its exterior surface comprising a material allowing gas passage into said porous matrix while preventing electrolyte liquid passage from the cell.

3. The gas diffusion semiconductor solar cell of claim 2 wherein said hydrophobic diffusion region comprises polytetrafluoroethylene coating or sheet.

4. The gas diffusion semiconductor solar cell of claim 1 wherein said porous matrix is made of a material selected from the group consisting of polytetrafluoroethylene, fritted glass, nickel, titanium, carbon, graphite and mixtures thereof.

5. The gas diffusion semiconductor solar cell of claim 1 wherein said porous matrix has electrical conductivity and serves as a current collector.

6. The gas diffusion semiconductor solar cell of claim 1 wherein said porous matrix is a non-electrical conductor and has a separate electrically conductive current collector.

7. The gas diffusion semiconductor solar cell of claim 1 wherein said semiconductor material is a p-type semiconductor.

8. The gas diffusion semiconductor solar cell of claim 7 wherein said p-type semiconductor is an appropriately doped material selected from the group consisting of GaP, ZnTe, InP, SiC and Si.

9. The gas diffusion semiconductor solar cell of claim 8 wherein said p-type semiconductor is selected from the group consisting of Zn-doped GaP, Ag-doped ZnTe, Zn-doped InP, Al-doped SiC and B-doped Si.

10. The gas diffusion semiconductor solar cell of claim 1 wherein said semiconductor material is an n-type semiconductor.

11. The gas diffusion semiconductor solar cell of claim 10 wherein said n-type semiconductor is an appropriately doped material selected from the group consisting of GaAs, CdSe, $TiO_2$, $MoS_2$, Si, $MoSe_2$ and $Fe_2O_3$.

12. The gas diffusion semiconductor solar cell of claim 1 wherein said counterelectrode comprises a light passing structure selected from the group consisting of nickel, platinum, ruthenium, titanium, carbon, tin oxide and indium oxide.

13. The gas diffusion semiconductor solar cell of claim 1 wherein said separator is a light passing membrane selected from the group consisting of sulfonated perfluoropolyethylene, polyethylene, polyvinylchloride, nylon, polymethacrylic acid and Thirsty Glass.

14. The gas diffusion semiconductor solar cell of claim 1 wherein said electrolyte is selected from the group consisting of acidic and basic aqueous electrolytes.

15. The gas diffusion semiconductor solar cell of claim 1 wherein said electrolyte is a non-aqueous electrolyte.

16. In a gas diffusion semiconductor solar cell, a gas diffusion photosensitive electrode comprising; a central electrolyte-porous matrix layer having an activated semiconductor material on one side adapted to be in contact with an electrolyte and a hydrophobic gas diffusion region on the opposite side adapted to be in contact with a supply of molecular gas for passage in sequence through said hydrophobic gas diffusion region and said central porous matrix layer to contact the semiconductor-electrolyte interface causing photofixation of said gas upon illumination of said semiconductor material.

17. The gas diffusion photosensitive electrode of claim 16 wherein said porous matrix diffusion layer has a hydrophobic diffusion region on its exterior surface comprising a material allowing gas passage into said porous matrix while preventing electrolyte liquid passage from the cell.

18. The gas diffusion photosensitive electrode of claim 17 wherein said hydrophobic diffusion region comprises polytetrafluoroethylene coating or sheet.

19. The gas diffusion photosensitive electrode of claim 16 wherein said porous matrix is made of a material selected from the group consisting of polytetrafluoroethylene, fritted glass, nickel, titanium, carbon, graphite and mixtures thereof.

20. The gas diffusion photosensitive electrode of claim 16 wherein said porous matrix has electrical conductivity and serves as a current collector.

21. The gas diffusion photosensitive electrode of claim 16 wherein said porous matrix is a non-electrical conductor and has a separate electrically conducting current collector.

22. The gas diffusion photosensitive electrode of claim 16 wherein said semiconductor material is a p-type semiconductor.

23. The gas diffusion photosensitive electrode of claim 22 wherein said p-type semiconductor is an appropriately doped material selected from the group consisting of GaP, ZnTe, InP, SiC and Si.

24. The gas diffusion photosensitive electrode of claim 23 wherein said p-type semiconductor is selected from the group consisting of Zn-doped GaP, Ag-doped ZnTe, Zn-doped InP, Zn-doped SiC and B-doped Si.

25. The gas diffusion photosensitive electrode of claim 16 wherein said semiconductor material is an n-type semiconductor.

26. The gas diffusion photosensitive electrode of claim 25 wherein said n-type semiconductor is an appropriately doped material selected from the group consisting of GaAs, CdSe, $TiO_2$, $MoS_2$, Si, $MoSe_2$ and $Fe_2O_3$.

27. A process for gaseous photofixation comprising the steps:

passing a gas through a hydrophobic gas diffusion region on one side of a porous matrix diffusion layer of a gas diffusion photosensitive electrode and contacting a semiconductor material supported by the other side of said porous matrix diffusion layer;

passing illumination through an opposing light passing counterelectrode and a liquid electrolyte in contact with said counterelectrode and said electrode to illuminate said semiconductor producing a shift in the potential of the semiconductor causing an electrode photocurrent, said electrode photocurrent causing fixation of said gas by reduction of the gas with a p-type semiconductor at the semiconductor-electrolyte interface with concomitant oxidation of the electrolyte at the counterelectrode or oxidation of the gas with an n-type semiconductor at the semiconductor-electrolyte interface with concomitant reduction of the electrolyte at the counterelectrode;

providing ionic conductance between the electrode and counterelectrode by a flowing liquid electrolyte in contact with said electrode and counterelectrode, the anolyte and catholyte portions of the electrolyte being chemically separated by a light passing and ionic conducting separator;

providing removal of the fixed gas from and supply of electroactive electrolyte to said electrode by said flowing electrolyte; and passing electrons through an external electronic circuit for completion of the electronic circuit.

28. The process of claim 27 wherein said hydrophobic gas diffusion region comprises polytetrafluoroethylene coating or sheet.

29. The process of claim 27 wherein said porous matrix is made of a material selected from the group consisting of polytetrafluoroethylene, fritted glass, nickel, titanium, carbon, graphite and mixtures thereof.

30. The process of claim 27 wherein said porous matrix is a non-electrical conductor and has a separate electrically conducting current collector.

31. The process of claim 27 wherein said semiconductor material is a p-type semiconductor.

32. The process of claim 31 wherein said p-type semiconductor is an appropriately doped material selected from the group consisting of GaP, ZnTe, InP, SiC and Si.

33. The process of claim 27 wherein said semiconductor material is an n-type semiconductor.

34. The process of claim 33 wherein said n-type semiconductor is an appropriately doped material selected from the group consisting of GaAs, $TiO_2$, CdSe, $MoS_2$, Si, $MoSe_2$ and $Fe_2O_3$.

35. The process of claim 27 wherein said counterelectrode comprises a light passing structure selected from the group consisting of nickel, ruthenium, platinum, titanium, carbon, tin oxide and indium oxide.

36. The process of claim 27 wherein said separator is a light passing membrane selected from the group consisting of sulfonated perfluoropolyethylene, polyethylene, polyvinylchloride, nylon, polymethacrylic acid and Thirsty Glass.

37. The process of claim 27 wherein said electrolyte is selected from the group consisting of acidic and basic aqueous electrolytes.

38. The process of claim 27 wherein said electrolyte is a non-aqueous electrolyte.

39. A process for molecular gas photo-reduction comprising the steps:

passing molecular gas to be reduced through a hydrophobic gas diffusion region on one side of a porous matrix diffusion layer of a gas diffusion photosensitive cathode and contacting a p-type semiconductor supported by the other side of said porous matrix diffusion layer;

passing illumination through an opposing light passing anode and a liquid electrolyte in contact with said anode and said cathode to illuminate said p-type semiconductor producing a positive shift in the potential of the semiconductor causing a cathodic photocurrent, said cathodic photocurrent causing reduction of the molecular gas to a fixed state at the semiconductor-electrolyte interface with concomitant oxidation of the electrolyte at the anode;

providing ionic conductance between the cathode and anode by a flowing liquid electrolyte in contact with said cathode and anode, the anolyte and catholyte portions of the electrolyte being chemically separated by a light passing and ionic conducting separator;

providing removal of the formed fixed material from and supply of electroactive electrolyte to said cathode by said flowing electrolyte; and passing electrons produced by oxidation of said electrolyte at said anode through an external electronic circuit to said cathode for completion of the electronic circuit, said external electronic circuit providing a bias voltage to said cathode from an external power source.

40. The process for molecular gas photoreduction of claim 39 wherein said hydrophobic gas diffusion region comprises polytetrafluoroethylene coating or sheet.

41. The process for molecular gas photoreduction of claim 39 wherein said porous matrix is made of a material selected from the group consisting of polytetrafluoroethylene, fritted glass, nickel, titanium, carbon, graphite and mixtures thereof.

42. The process for molecular gas photoreduction of claim 39 wherein said porous matrix has electrical conductivity and serves as a current collector.

43. The process for molecular gas photoreduction of claim 39 wherein said porous matrix is a non-electrical conductor and has a separate electrically conducting current collector.

44. The process for molecular gas photoreduction of claim 39 wherein said p-type semiconductor is an appropriately doped material selected from the group consisting of GaP, ZnTe, InP, SiC and Si.

45. The process for molecular gas photoreduction of claim 44 wherein said p-type semiconductor is selected from the group consisting of Zn-doped GaP, Ag-doped ZnTe, Zn-doped InP, Al-doped SiC and B-doped Si.

46. The process for molecular gas photoreduction of claim 39 wherein said counterelectrode comprises a light passing structure selected from the group consisting of nickel, platimum, titanium, carbon, ruthenium, tin oxide and indium oxide.

47. The process for molecular gas photoreduction of claim 39 wherein said separator is a light passing membrane selected from the group consisting of sulfonated perfluoropolyethylene, polyethylene, polyvinylchloride, nylon, polymethacrylic acid and Thirsty Glass.

48. The process for molecular gas photoreduction of claim 39 wherein said electrolyte is selected from the group consisting of acidic and basic aqueous electrolytes.

49. The process for molecular gas photoreduction of claim 39 wherein said electrolyte is a non-aqueous electrolyte.

50. The process for molecular gas photoreduction of claim 39 wherein said molecular gas is nitrogen which is reduced to ammonia or hydrazine.

51. The process for molecular gas photoreduction of claim 39 wherein said molecular gas is carbon dioxide which is reduced to methanol or methane.

52. A process for fuel gas photo oxidation comprising the steps:

passing fuel gas selected from the group consisting of methane, butane, propane, carbon monoxide and ammonia to be oxidized through a hydrophobic gas diffusion region on one side of a porous matrix diffusion layer of a gas diffusion photosensitive anode and contacting an n-type semiconductor supported by the other side of said porous matrix diffusion layer;

illuminating said n-type semiconductor producing a negative shift in the potential of the semiconductor causing an anodic photocurrent, said anodic photocurrent causing oxidation of said fuel gas at the semiconductor-electrolyte interface with concomitant reduction at a gas diffusion oxygen/air cathode;

providing ionic conductance between the cathode and anode by a liquid electrolyte in contact with said cathode and anode; and withdrawing electrical energy in an external circuit between the electrodes.

* * * * *